US008485650B2

(12) United States Patent
Misumi

(10) Patent No.: US 8,485,650 B2
(45) Date of Patent: Jul. 16, 2013

(54) METHOD FOR FILLING LIQUID-DISCHARGE-HEAD CARTRIDGE WITH LIQUID, AND METHOD AND APPARATUS FOR MANUFACTURING LIQUID-DISCHARGE-HEAD CARTRIDGE

(75) Inventor: Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 709 days.

(21) Appl. No.: 12/638,918

(22) Filed: Dec. 15, 2009

(65) Prior Publication Data

US 2010/0149290 A1 Jun. 17, 2010

(30) Foreign Application Priority Data

Dec. 17, 2008 (JP) ..... 2008-321033

(51) Int. Cl.
*B41J 2/175* (2006.01)
*B41J 2/165* (2006.01)

(52) U.S. Cl.
USPC ..... 347/85; 347/29; 347/30; 347/86

(58) Field of Classification Search
USPC ..... 347/29, 30, 33, 85, 86
See application file for complete search history.

(56) References Cited

U.S. PATENT DOCUMENTS 6,019,450 A * 2/2000 Mochizuki et al. ..... 347/23
2003/0007029 A1 1/2003 Kotaki
2007/0222815 A1* 9/2007 Kusakari ..... 347/29

FOREIGN PATENT DOCUMENTS

JP 2000-108383 A 4/2000

* cited by examiner

*Primary Examiner* — Jannelle M Lebron
(74) *Attorney, Agent, or Firm* — Canon USA, Inc., IP Division

(57) ABSTRACT

A method for filling a liquid-discharge-head cartridge with liquid includes a first step in which a suction operation is performed at a first suction pressure while a suction member is moved along the discharge port row in the discharge-port surface at a first moving speed to suck the liquid in the liquid container to fill the discharge ports, and a second step in which a suction operation is performed at a second suction pressure, which is lower than the first suction pressure, while the suction member is moved along the discharge port row in the discharge-port surface at a second moving speed, which is lower than the first moving speed to remove bubbles in the flow path.

9 Claims, 10 Drawing Sheets

FIG. 12

| | MOVING SPEED (mm/s) | | TIME (sec) | | SUCTION PRESSURE (kPa) | | AMOUNT OF SUCTION (g) | |
|---|---|---|---|---|---|---|---|---|
| | EMBODIMENT | COMPARISON EXAMPLE | EMBODIMENT | COMPARISON EXAMPLE | EMBODIMENT | COMPARISON EXAMPLE | EMBODIMENT | COMPARISON EXAMPLE |
| OUTWARD MOVEMENT | 8.0 | 3.5 | 1.5 | 3.4 | −60 | −60 | 0 | 0.05 |
| TURNING-BACK POINT | 0 | 0 | 1.0 | 1.0 | – | −45 | – | 0 |
| HOMEWARD MOVEMENT | 3.0 | 3.5 | 5.3 | 4.6 | −40 | −40 | 0.55 | 0.55 |
| TOTAL | | | 7.8 | 9.0 | | | 0.55 | 0.60 |

METHOD FOR FILLING LIQUID-DISCHARGE-HEAD CARTRIDGE WITH LIQUID, AND METHOD AND APPARATUS FOR MANUFACTURING LIQUID-DISCHARGE-HEAD CARTRIDGE

BACKGROUND OF THE INVENTION

1. Field of the Invention

The present invention relates to a method for filling a liquid-discharge-head cartridge with liquid, and a method and an apparatus for manufacturing the liquid-discharge-head cartridge.

2. Description of the Related Art

Conventionally, in a method for filling a liquid-discharge-head cartridge with liquid, the entirety of a discharge-port surface of a liquid-discharge head is sealed with a suction cap, which is an elastic member, and then liquid is sucked from all the discharge ports at once. In this filling method, because a large amount of liquid is sucked and a large amount of liquid is deposited on the discharge-port surface of the liquid-discharge head, a step of wiping the discharge-port surface is needed. Furthermore, removal of bubbles in the discharge ports is insufficient in conventional arrangements.

Japanese Patent Laid-Open No. 2000-108383 discloses a discharge recovery device that recovers discharge by suction through a suction tube made of an elastic member. In the discharge recovery method disclosed in Japanese Patent Laid-Open No. 2000-108383, the moving speed and suction pressure of the suction tube that is brought into contact with the discharge-port surface are constant.

Because the condition in a discharge port before being filled with liquid is different from that after being filled with liquid, if liquid is sucked at a constant suction pressure and suction rate, a malfunction may occur. That is, liquid filling may become insufficient, which may result in bubbles remaining in the discharge ports, and the amount of liquid suction increases, leading to unnecessary liquid consumption. This phenomenon is particularly evident in liquid-discharge heads having discharge ports of different sizes.

Moreover, in a manufacturing process of liquid-discharge-head cartridges, if the discharge ports are not filled with liquid to the ends thereof in a filling step, an accurate test cannot be performed in the subsequent print test step.

SUMMARY OF THE INVENTION

The present invention enables discharge ports to be quickly and assuredly filled with liquid during manufacturing of liquid-discharge-head cartridges and reduces the amount of liquid unnecessarily consumed by suction.

The present invention provides a method for filling a liquid-discharge-head cartridge with liquid, the liquid-discharge-head cartridge having a liquid container for storing liquid, a discharge-port surface having a discharge port row consisting of a plurality of discharge ports through which the liquid in the liquid container is discharged, and a flow path for communicating between the liquid container and the discharge ports. The method includes a first step in which a suction operation is performed at a first suction pressure while a suction member is moved along the discharge port row in the discharge-port surface at a first moving speed to suck the liquid in the liquid container to fill the discharge ports, and a second step in which a suction operation is performed at a second suction pressure, which is lower than the first suction pressure, while the suction member is moved along the discharge port row in the discharge-port surface at a second moving speed, which is lower than the first moving speed, to remove bubbles in the flow path after the first step.

The present invention enables discharge ports of liquid-discharge-head cartridges to be quickly and assuredly filled with liquid and reduces the amount of liquid consumed by suction during a liquid filling step.

Further features of the present invention will become apparent from the following description of exemplary embodiments with reference to the attached drawings.

BRIEF DESCRIPTION OF THE DRAWINGS

FIG. 12 is a table showing the operation conditions in the filling step according to the first embodiment.

DESCRIPTION OF THE EMBODIMENTS

The present invention is used in a step of filling a liquid-discharge head with liquid, which is performed between a liquid injection step of injecting liquid into a liquid container and a print test step in a process of manufacturing a liquid-discharge-head cartridge having the liquid container and the liquid-discharge head formed as a single part. In this step, a discharge-port surface of the liquid-discharge head is fixed so as to face upward, and liquid is sucked from discharge ports at a predetermined suction pressure through a suction tube brought into contact with the discharge-port surface. Thus, by moving the suction tube in contact with the discharge-port surface along discharge port rows at a predetermined speed while filling the discharge ports, to the ends thereof, in the discharge-port surface with liquid in the liquid container through a liquid flow path, a wiping function is also provided.

First, a liquid-discharge-head cartridge formed according to this embodiment, having a liquid container and a liquid-discharge head formed as a single part, will be described.

1. Liquid-Discharge-Head Cartridge H1000

Figure 1:
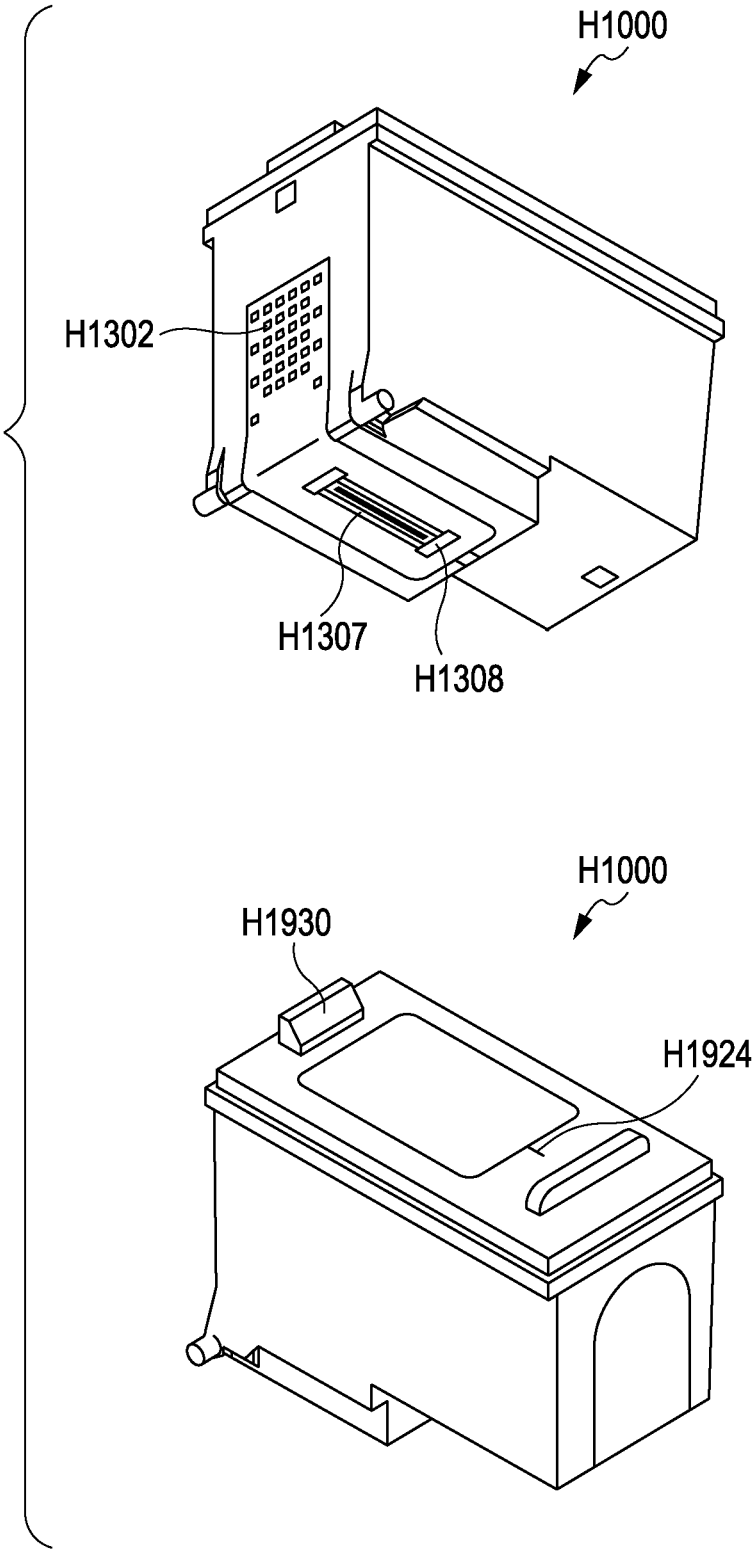
FIG. 1 is a liquid-discharge-head cartridge according to an embodiment of the present invention.
Figure 2:
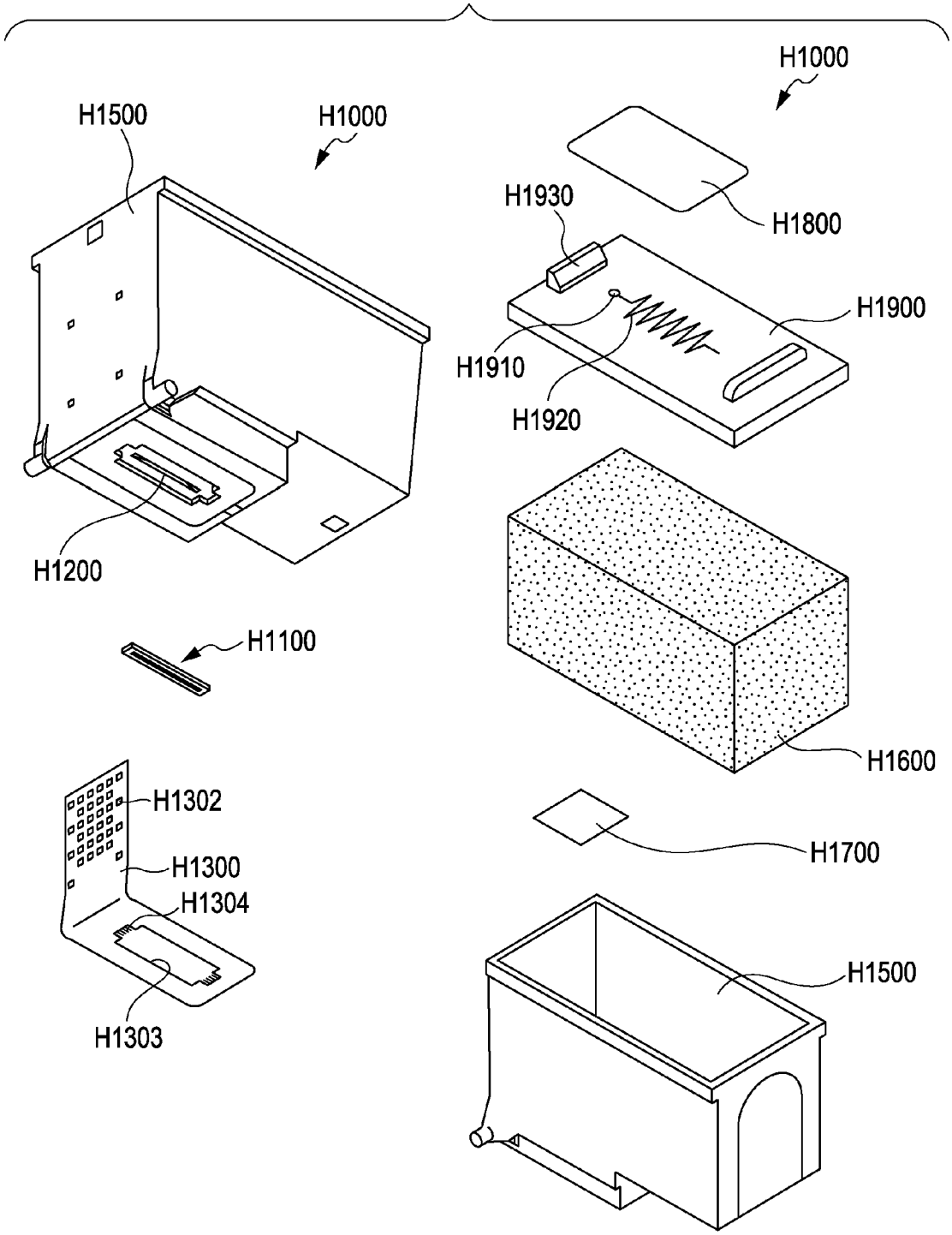
FIG. 2 is an exploded view of the liquid-discharge-head cartridge of FIG. 1.

FIGS. 1 and 2 are exploded perspective views of a liquid-discharge-head cartridge H1000. The liquid-discharge-head cartridge H1000 employs a bubble jet method using energy generating elements for generating heat energy. The liquid-discharge-head cartridge H1000 is also a liquid-discharge-head cartridge of a side-shooter type, in which the energy generating elements and the liquid discharge ports are disposed so as to face each other.

The liquid-discharge-head cartridge H1000 includes a liquid-discharge head H1100, an electrical wiring member H1300 having flying leads, a liquid container H1500, and a cap member H1900. The liquid-discharge-head cartridge H1000 further includes a sealing member H1800, a filter H1700, and a liquid absorber H1600.

1-1. Liquid-Discharge Head H1100

Figure 3:
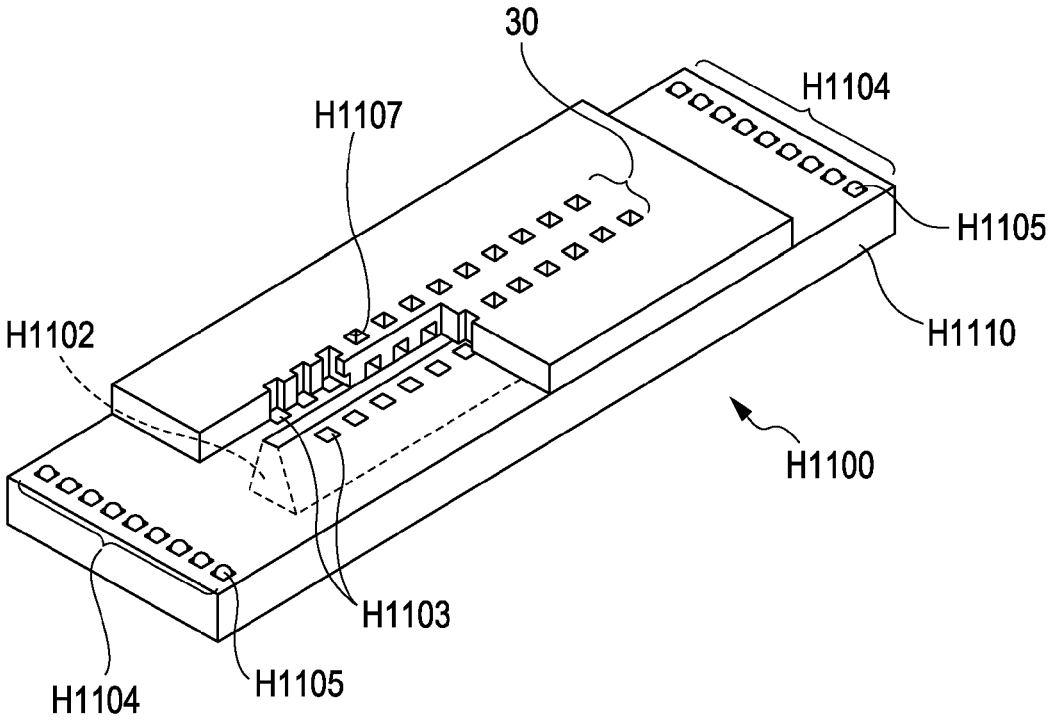
FIG. 3 shows a liquid-discharge head of the liquid-discharge-head cartridge according to an embodiment of the present invention.

FIG. 3 is a partially cutaway perspective view showing the structure of the liquid-discharge head H1100. In the liquid-discharge head 1110, a row of energy generating elements H1103 is disposed on either side of a supply port H1102. The rows of the energy generating elements H1103 are arranged in a staggered manner. Rows of discharge ports H1107 are arranged so as to be slightly shifted from each other such that the discharge ports H1107 are not aligned in a direction perpendicular to the direction of the rows. Liquid supplied from the supply port H1102 passes through a flow path and is discharged from discharge ports 1107 facing the energy generating elements H1103.

1-2. Electrical Wiring Member H1300 Having Flying Leads

An electrical wiring member H1300 having flying leads forms an electric signal path that applies a liquid discharge electric signal to the liquid-discharge head H1100. The electrical wiring member H1300 further has an opening H1303 to which the liquid-discharge head H1100 is incorporated, flying lead portions H1304 to be connected to electrical connection terminals H1104 of the liquid-discharge head H1100, and external signal input terminals H1302 for receiving electric signals from a main apparatus. The external signal input terminals H1302 and the flying lead portions H1304 are connected by a continuous copper-foil wiring pattern. Furthermore, bumps H1105 formed at the electrical connection terminals H1104 and the flying lead portions H1304 of the electrical wiring member H1300 corresponding to the electrical connection terminals H1104 are electrically connected to each other with a predetermined positional relationship.

1-3. Liquid Container H1500

A liquid container H1500 is formed of a resin material. As shown in FIG. 2, the liquid container H1500 accommodates an absorber H1600 that retains liquid therein and generates a negative pressure. Furthermore, the liquid container H1500 has a liquid flow path for guiding liquid to the liquid-discharge head H1100. The filter H1700 for preventing dust from entering the liquid-discharge head H1100 is attached to a boundary between the liquid flow path and a portion to which liquid from the liquid absorber H1600 located upstream of the liquid flow path is supplied. The liquid-discharge head H1100 is fixedly bonded to the liquid container H1500 such that the supply port 1102 of the liquid-discharge head H1100 communicates with the supply port H1200 in the liquid container H1500.

1-4. Cap Member H1900

The cap member H1900 welded to an upper opening of the liquid container H1500 seals the liquid container H1500. The cap member H1900 has a fine opening H1910 for releasing pressure fluctuations in the liquid container H1500 and a fine groove H1920 communicating therewith. By covering almost the entirety of the fine opening H1910 and the fine groove H1920 with the sealing member H1800 so as to leave an end of the fine groove H1920 uncovered, an air communication port H1924 is formed. The cap member H1900 also has an engaging portion H1930 for fixing the liquid-discharge-head cartridge H1000 to a liquid discharging apparatus.

A method for filling the discharge ports with liquid by sucking liquid in the liquid container during manufacturing of the above-described liquid-discharge-head cartridge, and a liquid filling device therefor will be described according to the following embodiments.

First Embodiment

2. Liquid Filling Device

Figure 4:
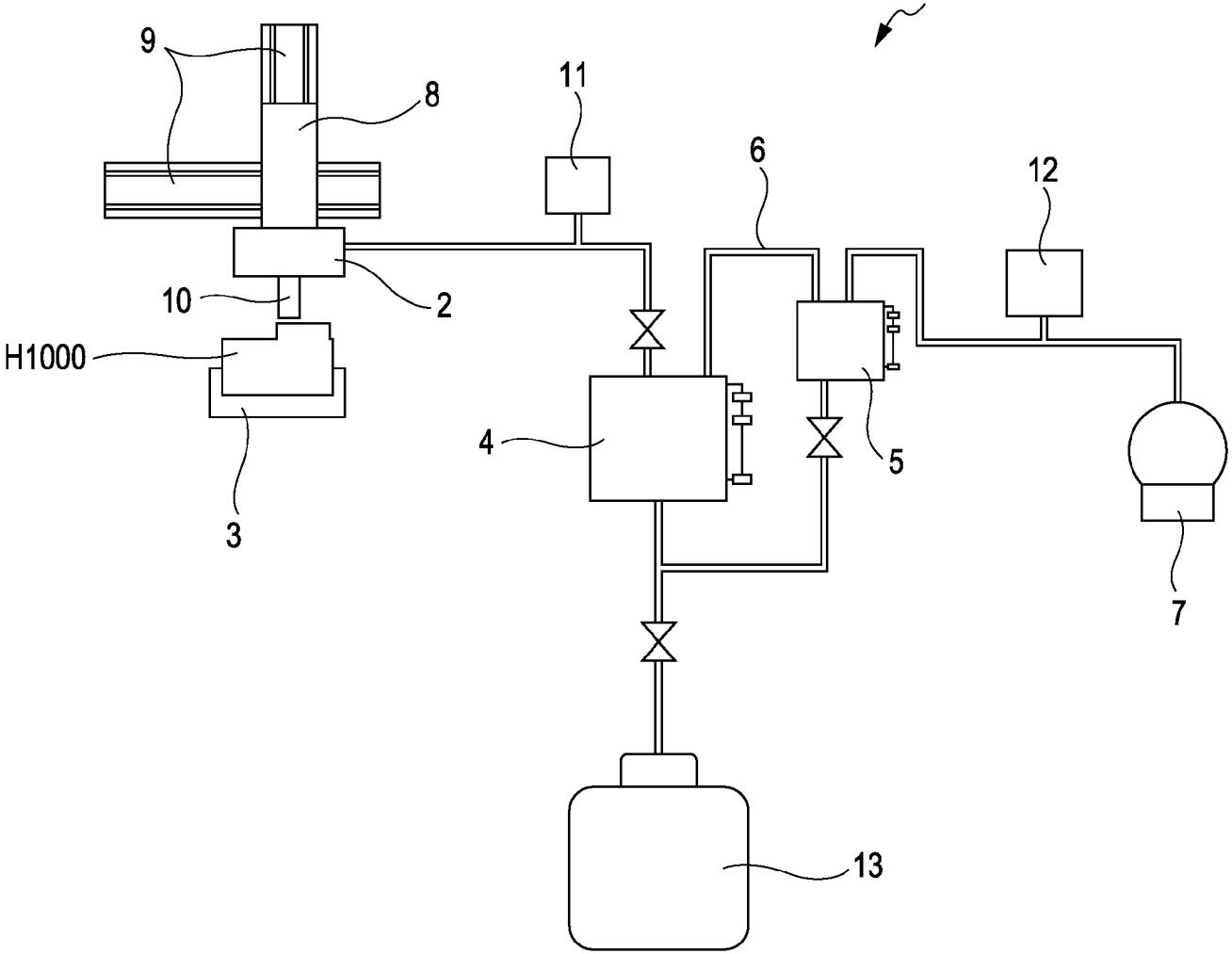
FIG. 4 is a schematic view of a liquid filling device according to a first embodiment.

FIG. 4 is a schematic view of a liquid filling device, which is a part of a manufacturing apparatus for embodying a method for manufacturing liquid-discharge-head cartridges according to this embodiment. A liquid filling device 1 includes a suction tube 10 serving as a suction member for sucking liquid, such as ink, in a liquid container.

The suction tube 10 is disposed so as to face the liquid-discharge-head cartridge H1000 fixed to a carriage jig 3 such that the discharge-port surface is the top surface. The suction tube 10 is attached to a suction unit 2 that is connected to a pump 7 via buffer chambers 4 and 5 and an air duct 6. The suction tube 10 can be brought into contact with the discharge-port surface of the liquid-discharge head H1100 by an air cylinder 8 that vertically moves the suction unit 2. With the above-described structure, the liquid filling device 1 can bring the suction tube 10 into contact with the discharge-port surface and can suck liquid from the discharge ports in the liquid-discharge head H1100 through the suction tube 10. Furthermore, the suction unit 2 and the air cylinder 8 are connected to a single axis robot 9 serving as a moving unit. This enables the suction tube 10 to be moved along the discharge port rows, which consist of a plurality of discharge ports, while being in contact with the discharge-port surface of the liquid-discharge head H1100.

An NC control (numerical control) portion attached to the device is used as a unit arranged to vary the moving speed of the suction tube 10. By setting a predetermined numbers, the speed of the single axis robot 9 can be controlled by NC control.

It is desirable that the suction tube 10 be an elastic member, and, in particular, be made of any one of urethane rubber, silicon rubber, and chlorinated butyl rubber. As shown in FIG. 3, two rows of discharge ports, arranged at intervals of 300 dpi, are disposed in the head in a staggered manner. The maximum width between the discharge port rows is 0.37 mm. Liquid is sucked by the suction tube having an inside diameter of 2.0 mm, which completely covers the two nozzle rows (in the width direction). The air duct 6 is provided with a digital vacuum gauge 11 for detecting suction pressure and a vacuum regulator 12, serving as a unit varying suction pressure, for adjusting the pressure in the air duct 6. This makes the suction pressure from the suction tube 10 variable, and, in the filling method, makes it possible to change the suction pressure from the suction tube 10 to a desired pressure. A waste liquid container 13 for storing waste liquid recovered from the suction tube 10 by the suction unit 2 is connected to the buffer chambers 4 and 5.

3. Liquid Filling Method

Figure 5A:
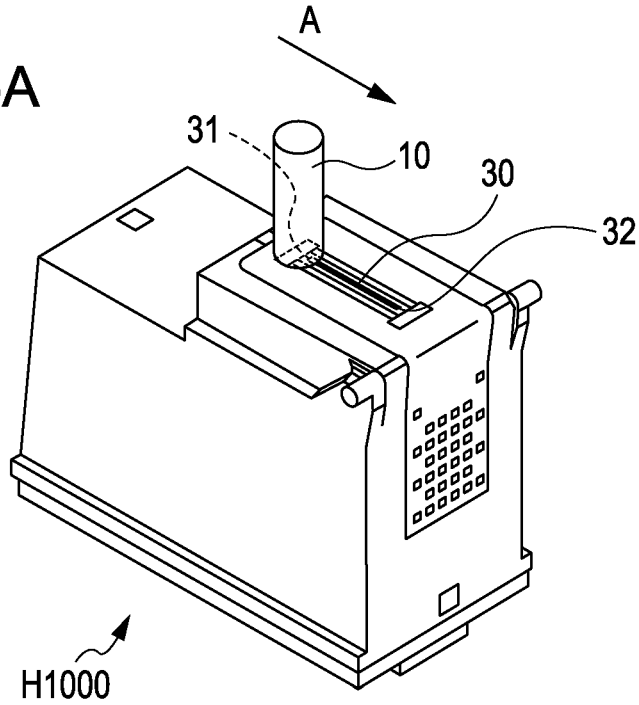
FIGS. 5A and 5B are perspective views showing a filling operation according to the first embodiment.
Figure 5B:
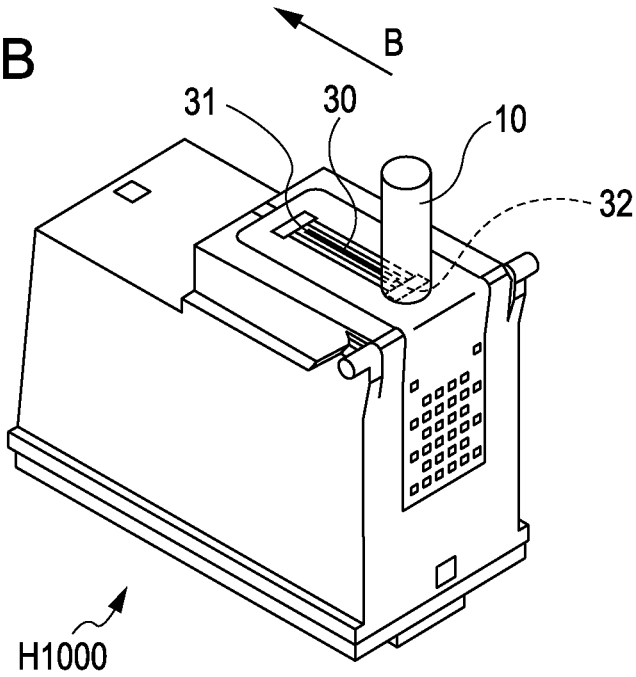

FIGS. 5A and 5B show a liquid filling method, which is included in a process in the method for manufacturing liquid-discharge-head cartridges. FIGS. 5A and 5B are perspective views showing a suction step in which the suction tube moves along the discharge port rows in the discharge-port surface of the liquid-discharge head to suck liquid.

First, the liquid-discharge head H1100 is prepared. The liquid-discharge head H1100 is fixed to the carriage jig 3 such that the discharge-port surface faces upward. The suction tube 10 is lowered with the air cylinder 8 and is brought into contact with a first end portion 31, which is an end of discharge port rows 30 in the discharge-port surface of the liquid-discharge head H1100 (see FIG. 5A).

3-1. First Step

Next, as a first step, a filling step, in which liquid in the liquid container reaches the discharge ports through the liquid flow path, is performed. Liquid begins to be sucked from the discharge ports through the suction tube 10 at a first suction pressure. The suction tube 10 is, while being in contact with the discharge-port surface, moved along the discharge port rows 30 toward a second end portion 32, which is the other end portion (arrow A in FIG. 5A: an outward movement), at a first speed to perform a liquid suction operation. Then, when the suction tube 10 reaches the second end portion 32, the liquid suction operation is temporarily stopped (see FIG. 5B).

3-2. Second Step

A second step is a step of completely filling the discharge ports with liquid while removing bubbles in the discharge ports.

First, using the vacuum regulator 12, the suction pressure is changed from the first suction pressure to a second suction pressure, which is lower than the first suction pressure. Suction is performed at the second suction pressure while the suction tube 10 is moved at a second moving speed in a direction opposite to the direction in which the suction tube 10 was moved in the first step (arrow B in FIG. 5B: a homeward movement). When the suction tube 10 has returned to the first end portion 31 (see FIG. 5A), the liquid suction operation is stopped. Finally, the suction tube 10 is raised and returned to an initial state. Thus, the filling method is completed.

4. Study on Operation Conditions

To make the filling condition in the above-described steps suitable, an experiment for optimally setting the suction pressure from the suction tube and the moving speed of the suction tube was performed.

4-1. Study on Operation Conditions in First Step

Figure 6:
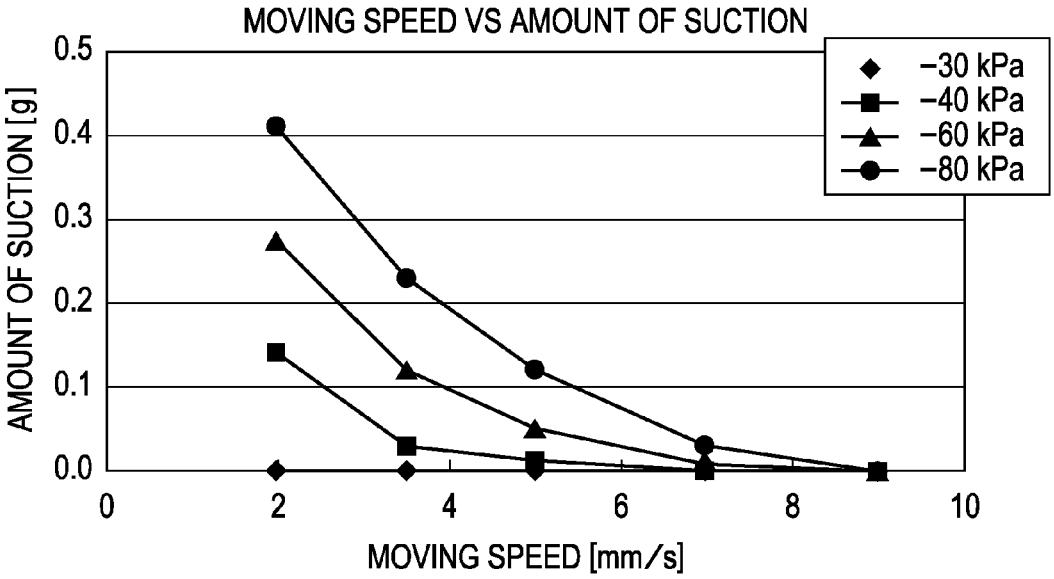
FIG. 6 is a graph showing the relationship between the moving speed of a suction tube and the amount of suction in a first step of the first embodiment.

FIG. 6 is a graph showing the relationship between the suction pressure of the suction tube, the moving speed of the suction tube, and the amount of liquid suction through the discharge ports into the suction tube (the amount of liquid consumption) in the above-described "3-1. First Step/Liquid Filling".

The amount of suction with respect to the moving speed was measured while varying the suction pressure from −30 kPa to −80 kPa. Since the suction pressure of the suction tube is negative pressure, the values are indicated as minus values. As the absolute value increases, the suction force increases. At the same time, at respective measurement points on the graph, the liquid filling conditions to the discharge ports was observed.

In the first step using the suction tube, liquid should reach at least the discharge ports. Desirably, the amount of liquid suction is 0. In order for that, as is clear from FIG. 6, the suction force is reduced, or the moving speed is increased even if the suction force is increased. However, when the suction pressure is −40 kPa and −30 kPa, the liquid filling conditions to the discharge ports was insufficient. In addition, to reduce the cycle time (tact time) (moving time) a high moving speed is desirable. Therefore, to achieve a sufficient liquid filling condition without consuming unnecessary liquid, the suction pressure is desirably in the range of from −60 kPa to −85 kPa. When the suction pressure becomes too large, small bubbles are generated in the flow path, or the amount of liquid suction is increased and liquid is consumed excessively.

Moreover, the moving speed of the suction tube is desirably in the range from 7 mm/s to 9 mm/s. When the moving speed is larger than 9 mm/s, the suction tube does not smoothly move over the discharge-port surface of the head, which may deform the tip of the suction tube. Thus, as optimal operation conditions of the suction tube according to this embodiment during an outward movement, desirably, the moving speed is 8 mm/s, and the suction pressure is −60 KPa.

4-2. Study on Operation Conditions in Second Step

Figure 7:
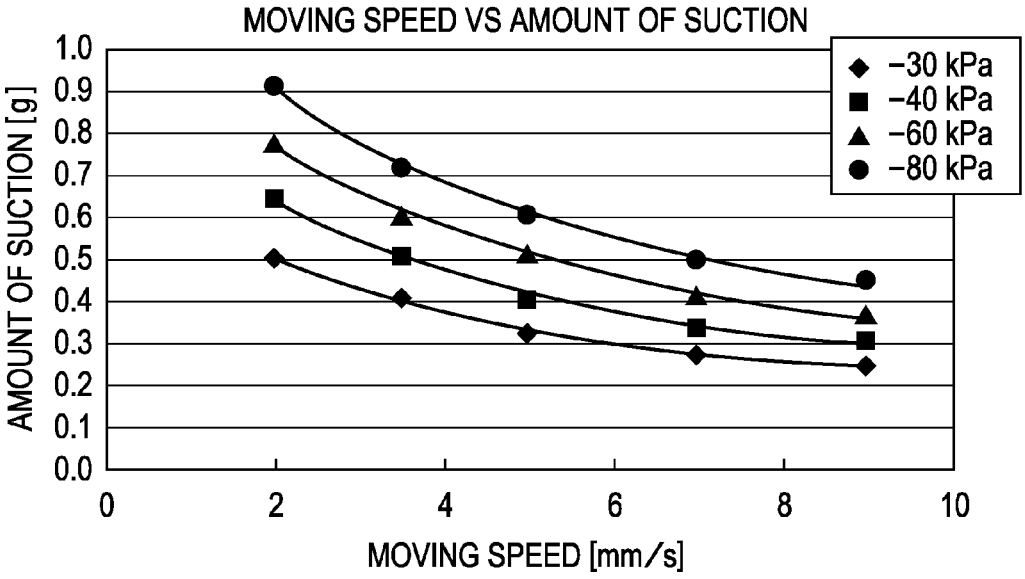
FIG. 7 is a graph showing the relationship between the moving speed of the suction tube and the amount of suction in a second step of the first embodiment.

FIG. 7 is a graph showing the relationship between the suction pressure of the suction tube, the moving speed of the suction tube, and the amount of liquid suction through the discharge ports into the suction tube (the amount of liquid consumption) in the above-described "3-2. Second Step/Removal of Bubbles". The amount of suction with respect to the moving speed was measured while varying the suction pressure from −30 kPa to −80 kPa.

In a conventional suction recovery method in which both the moving speed in reciprocating movement and the suction pressure are constant, the amount of liquid suction is about 0.6 g. Thus, in this embodiment, verification was performed based on a judgment criterion in which the case where the amount of suction during homeward movement of the suction tube is 0.6 g or less is regarded as the optimal condition.

As is clear from FIG. 7, to make the amount of suction 0.6 g or less, the suction force is reduced, or the moving speed is increased even if the suction force is increased. That is, when the suction pressure is −80 kPa, the moving speed is set to 5 mm/s or more, when the suction pressure is −60 kPa, the moving speed is set to 3.5 mm/s or more, and when the suction pressure is −40 kPa, the moving speed is set to 2.2 mm/s or more. When the suction pressure is −30 kPa, the amount of suction is 0.6 g or less at all the measured moving speeds.

On the other hand, to reduce residual bubbles in the discharge ports, a low moving speed is desirable.

Figure 8:
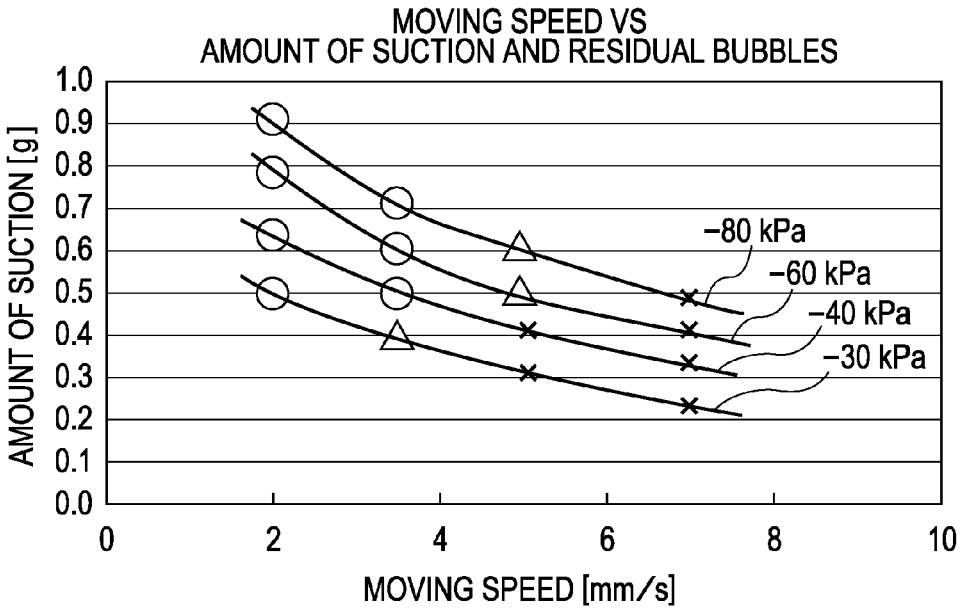
FIG. 8 is a graph showing the relationship between the moving speed of the suction tube, the amount of suction, and a liquid filling condition of the first embodiment.

FIG. 8 shows the result of observations of the liquid filling conditions in the discharge ports at the respective measurement points plotted in FIG. 7. In FIG. 8, ○, Δ, and x respectively indicate that there are no, some, and considerable residual bubbles in the discharge ports.

From FIG. 8, to make the amount of suction less than 0.6 g and to eliminate residual bubbles in the discharge ports, it is desirable that the suction pressure be set from −30 kPa to −40 kPa, and the moving speed of the suction tube be set from 2 mm/s to 3.5 mm/s. More specifically, it became clear that the filling method should be performed at a moving speed of 3.5 mm/s when the suction pressure is −40 kPa, and at a moving speed of 2.0 mm/s when the suction pressure is −30 kPa. Thus, as optimal operation conditions of the suction tube according to this embodiment during a homeward movement, desirably, the moving speed is 3 mm/s, and the suction pressure is −40 kPa.

4-3. Summary of Operation Conditions

Figure 9:
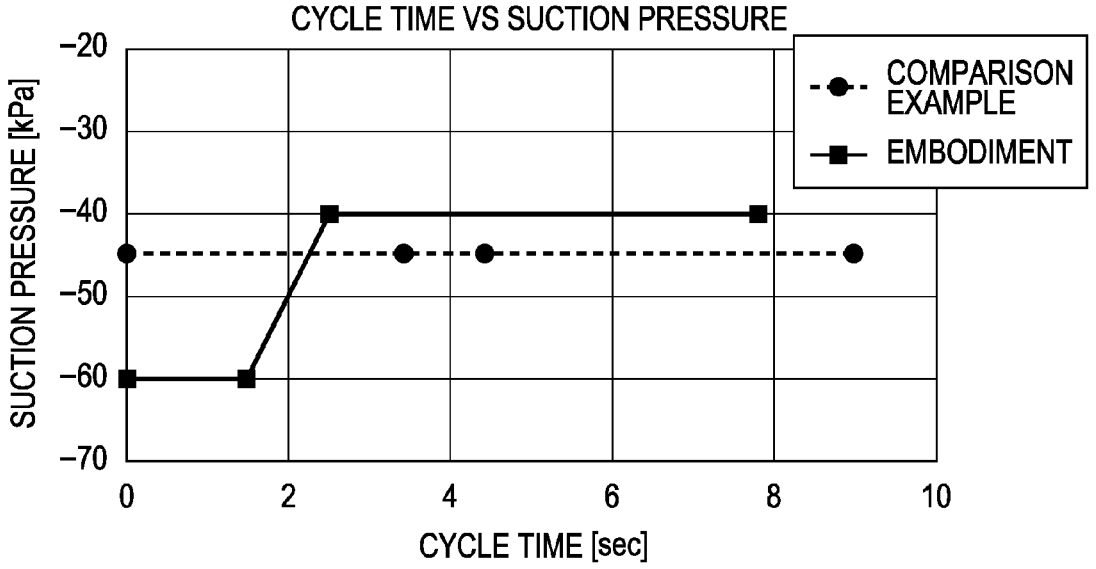
FIG. 9 is a graph showing the result of the table in FIG. 12.

FIG. 12 shows the operation conditions in the filling step according to this embodiment. FIG. 12 also shows comparison examples in which the filling method was performed at the same moving speed and suction pressure during outward and homeward movements. FIG. 9 is a graph showing the result of the table of FIG. 12.

In this embodiment, compared to the comparison example, the cycle time (tact time) (moving time) was reduced from 9.0 seconds to 7.8 seconds (−1.2 seconds), and the amount of suction was reduced from 0.60 g to 0.55 g (−0.05 g). Furthermore, no residual bubbles in the discharge ports were observed.

The relationship between the first suction step and the second suction step of the present invention is as follows:

The first suction pressure is from 1.5 to 2.8 times larger than the second suction pressure.

The first moving speed is from 2 to 4.5 times faster than the second moving speed.

Furthermore, in this embodiment, because the suction tube reciprocates over the head in the first and second suction steps, the structure of the suction device can be simplified and the cycle time (tact time) can be reduced.

Thus, with the method for manufacturing liquid-discharge-head cartridges according to this embodiment, while reducing the cycle time (tact time) in the step of filling the discharge ports with liquid, the discharge ports can be assuredly filled with liquid. This enables liquid-discharge-head cartridges to be produced at a high efficiency. Furthermore, because the amount of liquid suction is reduced, unnecessary consumption of liquid in the liquid container is eliminated. Moreover, because bubbles in the flow path can be efficiently removed, a print test in the subsequent print check step of the liquid-discharge head can be appropriately performed. Thus, it is possible to realize high-quality liquid-discharge-head cartridges.

Second Embodiment

Figure 10:
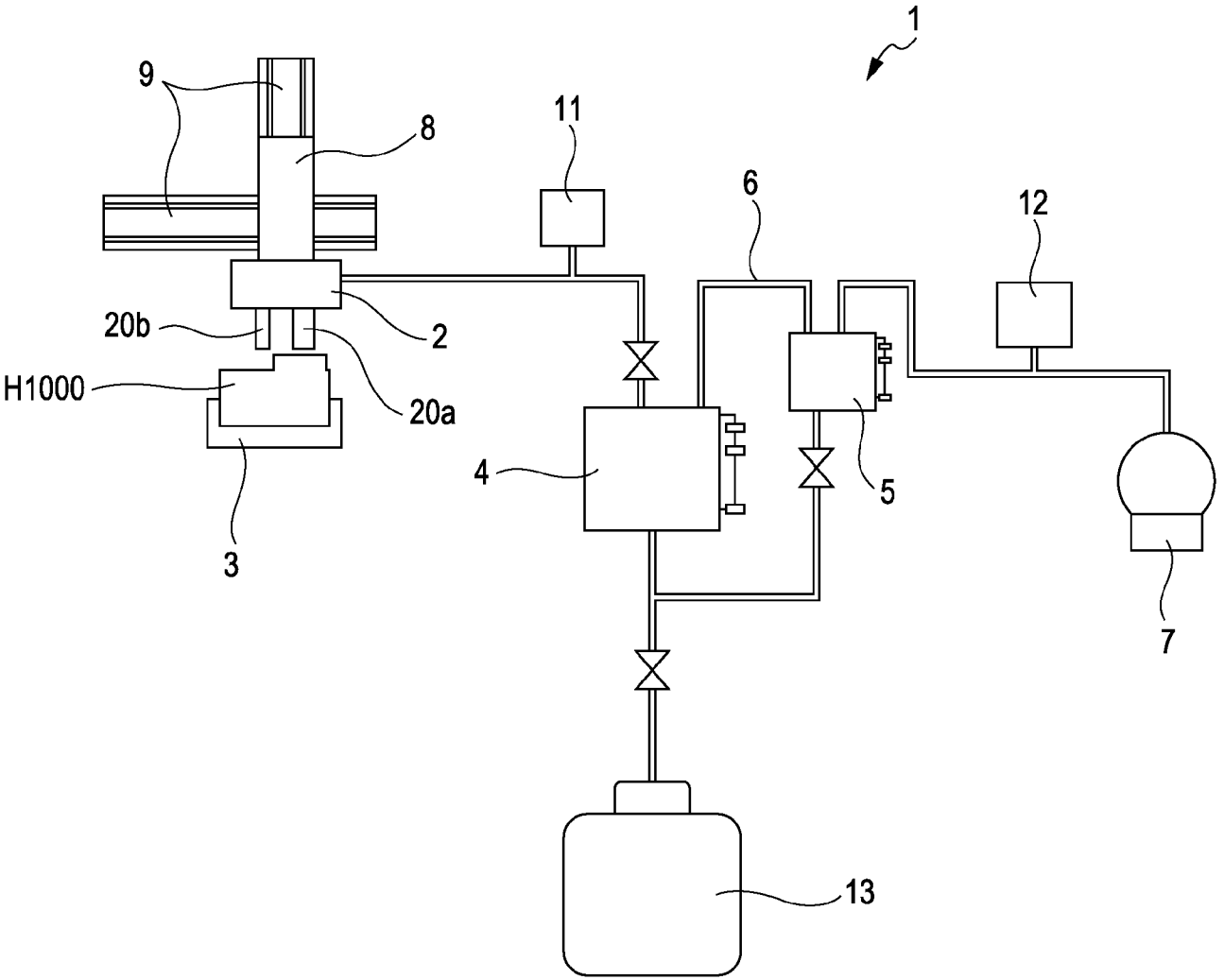
FIG. 10 is a schematic view of a liquid filling device according to a second embodiment.
Figure 11:
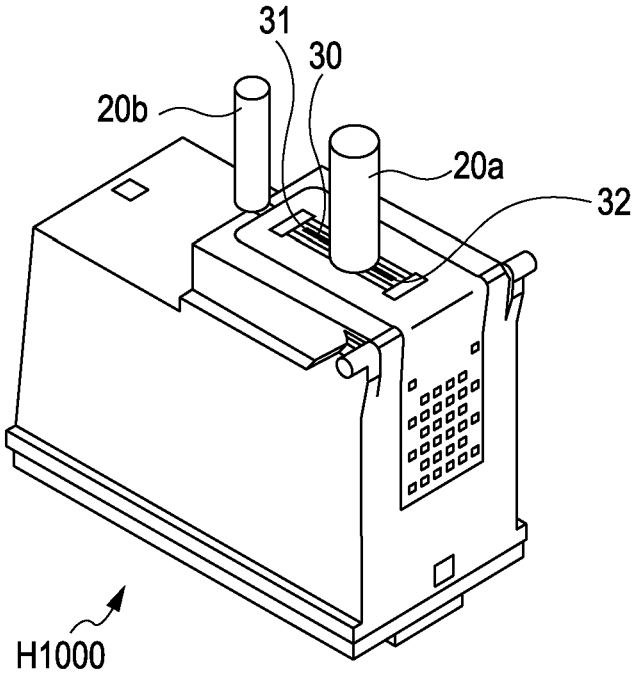
FIG. 11 is a perspective view showing a filling operation according to the second embodiment.

FIG. 10 is a schematic view showing the structure of a liquid filling device, which is a part of a manufacturing apparatus for embodying a method for manufacturing liquid-discharge-head cartridges according to a second embodiment of the present invention. FIG. 11 is a perspective view showing that a suction tube of the liquid filling device of this embodiment performs a filling method while moving along a liquid-discharge head.

The liquid filling device according to this embodiment differs from that according to the first embodiment in that it includes two suction tubes 20*a* and 20*b* that are brought into contact with a discharge-port surface of the liquid-discharge head, having different cross-sectional areas, i.e., suction areas. The first suction tube 20*a* having a relatively large contact surface and the second suction tube 20*b* having a relatively small contact surface are attached to a suction unit 2 with a sufficient distance therebetween in the direction of the discharge port rows 30. The "sufficient distance" means a distance greater than the length of the discharge port rows. It is desirable that the area of the first suction tube be about three times larger than the area of the second suction tube.

The other structures of the liquid filling device according to this embodiment are the same as the structures of the liquid filling device according to the first embodiment, and the liquid filling device according to this embodiment is the same as that according to the first embodiment in that it is used in the filling step between the liquid injection step and the print test step.

In the first embodiment, the first and second steps are performed while one suction tube reciprocates once between the end portions of the discharge port rows. In this embodiment, the first and second steps are performed while the first and second suction tubes 20*a* and 20*b*, maintaining a distance therebetween, move once between the end portions of the discharge port rows in one direction. Although the suction recovery method according to this embodiment differs from that according to the first embodiment in this point, advantages obtained therefrom are substantially the same as those obtained from the first embodiment.

5. Liquid Filling Method

Similarly to the first embodiment, the liquid-discharge head H1100 is fixed to the carriage jig 3 such that the discharge-port surface of the liquid-discharge head H1100 faces upward. The first and second suction tubes 20*a* and 20*b* are lowered by the air cylinder 8, and only the tubular first suction tube 20*a*, having a diameter of 3.5 mm, is brought into contact with the first end portion 31 of the discharge port rows 30 in the discharge-port surface of the liquid-discharge head H1100.

First, as a first step, a suction operation is performed on the discharge port rows from end to end with the first suction tube 20*a*, at a first suction pressure of −60 kPa and a first moving speed of 7.0 mm/s. Next, as a second step, a second suction pressure of the tubular second suction tube 20*a*, having a diameter of 2.0 mm, is changed to −40 kPa, which is lower than the first suction pressure, and a suction operation is performed on the discharge port rows from end to end at a second moving speed of 3.5 mm/s, which is lower than the first moving speed. When the second suction tube 20*b* reaches the second end portion 32, the suction pressure is returned to 0, and the first and second suction tubes 20*a* and 20*b* are removed from the discharge-port surface and raised to the initial position.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-321033, filed Dec. 17, 2008 which is hereby incorporated by reference herein in its entirety.

What is claimed is:

1. A method for filling a liquid-discharge-head cartridge with liquid, the liquid-discharge-head cartridge having a liquid container for storing liquid, a discharge-port surface having a discharge port row consisting of a plurality of discharge ports through which the liquid in the liquid container is discharged, and a flow path for communicating between the liquid container and the discharge ports, the method comprising:

a first step in which a suction member moves along the discharge port row in the discharge-port surface while wiping the discharge-port surface and sucking the liquid in the liquid container through the discharge port at a first suction pressure; and a second step in which the suction member moves along the discharge port row in the discharge-port surface while wiping the discharge-port surface and sucking the liquid in the discharge port at a second suction pressure which is lower than the first suction pressure after the first step, wherein the first step corresponds to an outward moving of the suction member along the discharge port row, and the second step corresponds to a homeward moving of the suction member along the discharge port row.

2. The method for filling a liquid-discharge-head cartridge with liquid according to claim 1, wherein the first suction pressure is from 1.5 to 2.8 times larger than the second suction pressure.

3. The method for filling a liquid-discharge-head cartridge with liquid according to claim 1, wherein the cross-sectional area of the suction member used in the first suction step is larger than the cross-sectional area of the suction member used in the second suction step.

4. A method for manufacturing liquid-discharge-head cartridges comprising:

a step of preparing a liquid-discharge-head cartridge including a liquid container for storing liquid and a discharge-port surface having a discharge port row consisting of a plurality of discharge ports through which liquid in the liquid container is discharged, and a flow path for communicating between the liquid container and the discharge ports;

a first step in which a suction member moves along the discharge port row in the discharge-port surface while wiping the discharge-port surface and sucking the liquid in the liquid container through the discharge port at a first suction pressure; and a second step in which the suction member is moved along the discharge port row in the discharge-port surface while wiping the discharge-port surface and sucking the liquid in the discharge port at a second suction pressure which is lower than the first suction pressure after the first step, wherein the first step corresponds to an outward moving of the suction member along the discharge port row, and the second step corresponds to a homeward moving of the suction member along the discharge port row.

5. An apparatus, to which a liquid-discharge-head cartridge is attached, manufactured by the method according to claim 4, the apparatus comprising:

a suction member provided so as to be in contact with the discharge-port surface to suck liquid;

a unit arranged to generate suction pressure to suck the liquid in the liquid container into the discharge port;

a unit arranged to vary the suction pressure of the suction member in the first step and the suction member in the second step; and a unit arranged to move the suction member along the discharge port row in the discharge-port surface.

6. A method for filling a liquid-discharge-head cartridge with liquid, the liquid-discharge-head cartridge having a liquid container for storing liquid, a discharge-port surface having a discharge port row consisting of a plurality of discharge ports through which the liquid in the liquid container is discharged, and a flow path for communicating between the liquid container and the discharge ports, the method comprising:

a first step in which a suction member moves along the discharge port row in the discharge-port surface while wiping the discharge-port surface and sucking the liquid in the liquid container through the discharge port at a first suction pressure; and a second step in which the suction member moves along the discharge port row in the discharge-port surface while wiping the discharge-port surface and sucking the liquid in the discharge port at a second suction pressure which is lower than the first suction pressure after the first step, wherein the suction member in the first step moves along the discharge port row at a first moving speed, and wherein the suction member in the second step moves along the discharge port row at a second moving speed lower than the first moving speed.

7. The method for filling a liquid-discharge-head cartridge with liquid according to claim 6, wherein the first moving speed is from 2 to 4.5 times faster than the second moving speed.

8. A method for manufacturing liquid-discharge-head cartridges comprising:

a step of preparing a liquid-discharge-head cartridge including a liquid container for storing liquid and a discharge-port surface having a discharge port row consisting of a plurality of discharge ports through which liquid in the liquid container is discharged, and a flow path for communicating between the liquid container and the discharge ports;

a first step in which a suction member moves along the discharge port row in the discharge-port surface while wiping the discharge-port surface and sucking the liquid in the liquid container through the discharge port at a first suction pressure; and a second step in which the suction member is moved along the discharge port row in the discharge-port surface while wiping the discharge-port surface and sucking the liquid in the discharge port at a second suction pressure which is lower than the first suction pressure after the first step, wherein the suction member in the first step moves along the discharge port row at a first moving speed, and wherein the suction member in the second step moves along the discharge port row at a second moving speed lower than the first moving speed.

9. A method for filling a liquid-discharge-head cartridge with liquid, the liquid-discharge-head cartridge having a liquid container for storing liquid, a discharge-port surface having a discharge port row consisting of a plurality of discharge ports through which the liquid in the liquid container is discharged, and a flow path for communicating between the liquid container and the discharge ports, the method comprising:

a first step in which a suction member moves along the discharge port row in the discharge-port surface while wiping the discharge-port surface and sucking the liquid in the liquid container through the discharge port at a first suction pressure; and a second step in which the suction member moves along the discharge port row in the discharge-port surface while wiping the discharge-port surface and sucking the liquid in the discharge port at a second suction pressure which is lower than the first suction pressure after the first step, wherein the first step corresponds to an outward moving of the suction member along the discharge port row, and the second step corresponds to a homeward moving of the suction member along the discharge port row.

wherein the suction member in the first step moves along the discharge port row at a first moving speed, and wherein the suction member in the second step moves along the discharge port row at a second moving speed lower than the first moving speed.

* * * * *